US009004654B2

(12) United States Patent
Hayashi et al.

(10) Patent No.: US 9,004,654 B2
(45) Date of Patent: Apr. 14, 2015

(54) INK CARTRIDGE, INK JET RECORDING SYSTEM AND INK JET RECORDING APPARATUS

(71) Applicant: Canon Kabushiki Kaisha, Tokyo (JP)

(72) Inventors: Hiroki Hayashi, Kawasaki (JP); Keisuke Matsuo, Yokohama (JP); Kenta Udagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/791,436

(22) Filed: Mar. 8, 2013

(65) Prior Publication Data

US 2013/0187996 A1 Jul. 25, 2013

Related U.S. Application Data

(63) Continuation of application No. 13/089,095, filed on Apr. 18, 2011, now Pat. No. 8,419,173.

(30) Foreign Application Priority Data

Apr. 20, 2010 (JP) ..... 2010-097077

(51) Int. Cl.
*B41J 2/175* (2006.01)

(52) U.S. Cl.
CPC ..... *B41J 2/17536* (2013.01); *B41J 2/175* (2013.01); *B41J 2/17513* (2013.01); *B41J 2/1752* (2013.01); *B41J 2/17523* (2013.01); *B41J 2/17596* (2013.01)

(58) Field of Classification Search
USPC ..... 347/84–87
See application file for complete search history.

(56) References Cited

U.S. PATENT DOCUMENTS

| | | | | |
|---|---|---|---|---|
| 5,903,292 | A * | 5/1999 | Scheffelin et al. | 347/86 |
| 6,116,723 | A * | 9/2000 | Childers | 347/85 |
| 6,224,199 | B1 * | 5/2001 | Yamaguchi et al. | 347/85 |
| 7,086,722 | B2 * | 8/2006 | Aruga | 347/86 |
| 7,144,104 | B2 * | 12/2006 | Katayama | 347/86 |
| 7,152,965 | B2 * | 12/2006 | Ishizawa et al. | 347/86 |
| 8,419,173 | B2 * | 4/2013 | Hayashi et al. | 347/85 |
| 2004/0201652 | A1 * | 10/2004 | Katayama | 347/85 |
| 2005/0088497 | A1 * | 4/2005 | Katayama et al. | 347/86 |
| 2005/0099473 | A1 | 5/2005 | Katayama | |
| 2006/0082626 | A1 * | 4/2006 | Oikawa et al. | 347/86 |
| 2006/0192818 | A1 * | 8/2006 | Penciu et al. | 347/84 |
| 2007/0030302 | A1 * | 2/2007 | Yamada | 347/31 |
| 2007/0153067 | A1 * | 7/2007 | Kumagai et al. | 347/86 |

FOREIGN PATENT DOCUMENTS

| | | | |
|---|---|---|---|
| CN | 1086343 | C | 6/2002 |
| CN | 1911667 | A | 2/2007 |
| EP | 1125747 | A2 | 8/2001 |
| JP | H07-025021 | A | 1/1995 |
| JP | 2003-251826 | A | 9/2003 |
| JP | 2007-038591 | A | 2/2007 |

* cited by examiner

*Primary Examiner* — Matthew Luu
*Assistant Examiner* — Lily Kemathe
(74) *Attorney, Agent, or Firm* — Canon USA Inc IP Division

(57) ABSTRACT

An ink cartridge adopts a construction in which an air seal and an ink seal are arranged on the cartridge side and in which sealing between the ink cartridge and the recording apparatus is performed with a radial seal.

18 Claims, 14 Drawing Sheets

INK CARTRIDGE, INK JET RECORDING SYSTEM AND INK JET RECORDING APPARATUS

CROSS REFERENCE TO RELATED APPLICATIONS

The present application is a continuation of U.S. patent application Ser. No. 13/089,095, filed on Apr. 18, 2011, the content of which is expressly incorporated by reference herein in its entirety. This application also claims the benefit of Japanese Patent Application No. 2010-097077 filed Apr. 20, 2010, which is hereby incorporated by reference herein in its entirety.

BACKGROUND OF THE INVENTION

1. Field of the Invention

The present invention relates to an ink cartridge for storing ink for use in inkjet recording, to an inkjet recording system comprising an ink jet recording apparatus connected to an ink cartridge and to an ink jet recording apparatus. Preferably the ink jet cartridge is detachably attached to the ink jet recording apparatus which is equipped with a connection member making it possible to supply ink to the ink cartridge through application of pneumatic pressure.

2. Description of the Related Art

Ink jet recording apparatuses are available as a variety of products ranging from ones for consumer use involving printing in a relatively small amount to ones for office or commercial use allowing printing in a relatively large amount.

Of these, ink jet recording apparatuses for printing in a large amount employ a large-volume ink cartridge for a reduction in the replacement frequency of the ink cartridge. An ink cartridge of this type adopts a construction suited to be installed within a recording apparatus. And, in such a recording apparatus, ink is supplied through connection between the ink cartridge and a recording head (or a sub tank connected to the recording head) via an ink supply tube.

Further, in an inkjet recording apparatus for office or commercial use intended for printing in a large amount, an improvement of printing speed is required.

In an ink jet recording apparatus using an ink supply tube, a significant pressure loss in the supply tube may occur, so that, to supply ink in a stable manner, it is advantageous to provide a construction which helps reduce the pressure loss. In a construction achieving an improvement in terms of printing speed, pressure is applied to the ink stored in, for example, an ink cartridge, to forcibly generate an ink flow toward the recording head, thereby supplying a sub tank with ink in a necessary and sufficient amount. As an example of a system for generating pressure, a system is known in which an ink cartridge is attached to an ink jet recording apparatus in an airtight configuration and pressurized air is applied to the ink cartridge.

A configuration is generally known in which a structure related to ink supply and a structure related to pressurization are individually provided and in which they are independently connected to an ink cartridge.

In contrast, Japanese Patent Application Laid-Open No. 2004-306496 proposes a construction which is integrally equipped with a structure for ink supply and a structure for pressurization.

In the following, the construction as discussed in Japanese Patent Application Laid-Open No. 2004-306496 will be briefly described with reference to a drawing. As illustrated in FIG. 11, an ink jet recording apparatus 110 is equipped with a recording head 112 mounted on a carriage 111, and a sub tank 113 retaining ink supplied from an ink cartridge 150 described below. Further, there is provided an attachment portion 117, to which the ink cartridge 150 is detachably attached. Further, in the attachment portion 117, a connection member 120 is arranged that is connected to an ink supply member of the ink cartridge 150 when the ink cartridge 150 is attached. The connection member 120 is equipped with an ink outlet path 125, an ink outlet port (not illustrated), an air inlet path 122, and an air inlet port 121. And, the connection member 120 is connected to an ink tube 116 constituting an ink path for ink supply through connection to the sub tank 113 of the recording head 112. Further, via the air inlet path 122, the air inlet port 121 is connected to an air tube 115 constituting an air path connected to an air pump 114, which generates pressurized air for sending ink with pressure from the ink cartridge 150 to the sub tank 113.

And, an air seal 171 is provided so as to surround the ink outlet 125, the air inlet path 122, and the air inlet port 121. The air seal 171 is equipped with a lip-like peripheral edge formed of an elastic material and configured to be brought into intimate contact with the periphery of an opening 153 of the ink cartridge 150 to seal the inner space thereof when the ink cartridge 150 and the connection member 120 are connected to each other.

As illustrated in FIG. 12, the ink cartridge 150 for attachment to the ink jet recording apparatus 110 as described above includes a casing 151, which contains an ink accommodation body unit 160 composed of a spout 162 and an ink accommodation body 161. The ink accommodation body 161 consists of an ink bag formed of a flexible film. On the other hand, the spout 162 is equipped with an ink seal 163 consisting of an elastic member equipped with an ink supply port 167 which is connected to a needle-like pipe constituting the ink outlet path 125 of the connection member 120 of the ink jet recording apparatus 110. The ink accommodation body unit 160 is mounted on a regulation member 155 of the casing 151 by utilizing a part of the spout and with a play (clearance gap) between the spout 162 and the regulation member 155. Further, the casing 151 is equipped with an opening 153 configured to expose the ink supply port 167, with the ink accommodation body unit 160 arranged in the casing 151. A space portion 154 of the ink cartridge 150 communicates with the exterior via the opening 153 and the clearance gap between the regulation member 155 and the spout 162.

FIG. 13 illustrates the ink cartridge 150 illustrated in FIG. 12 as attached to the ink jet recording apparatus 110 illustrated in FIG. 11. The ink outlet path 125 is inserted through the ink supply port 167 of the ink cartridge 150 to communicate with ink 140 stored in the ink accommodation body 161 of the ink accommodation body unit 160. At the same time, the air seal 171 is pressed against and held in contact with the periphery of the opening 153 to thereby block the opening 153, with the abutment portion (lip portion) 171*a* of the air seal 171 being deformed. As a result, the space portion 154 formed by the inner space of the ink cartridge 150 is enclosed except that it communicates with the air inlet port 121. In this state, the air pump 114 is operated to send air in, whereby the interior of the ink cartridge 150 is pressurized to thereby compress the ink accommodation body 161, thereby sending the ink 140 to the sub tank 113 of the recording head 112 under pressure.

However, in the construction in which the air seal 171 is provided in the ink jet recording apparatus 110, when the number of times that the ink cartridge 150 is replaced increases, the material of the air seal 171 deteriorates in characteristics, making it difficult to form the airtight construction for executing the pressurized ink supply. More specifically, in the construction as discussed in Japanese Patent Application Laid-Open No. 2004-306496, the air seal 171 suffers a great elastic deformation, showing creeping with the passage of time. In this case, the pressurization force can escape to the exterior from the lip portion 171*a*. To prevent the escape of the pressurization force, the air seal 171 is required to retain durability during the service life of the recording apparatus, which means there are limitations in terms of material selection, configuration for securing sealing property, etc.

Further, the ink cartridge 150 is inserted, with the air seal 171 and the opening 153 of the ink cartridge 150 facing each other. Thus, the attachment is completed by causing the ink cartridge 150 to abut the lip portion 171*a*, so that the degree of conformity to the attachment stroke of the ink cartridge 150 is rather low (so the ink cartridge may need to be inserted several times before the ink cartridge properly abuts the lip portion 171*a*). To increase the degree of conformity to the stroke, it might be possible to operate the seal structure as a whole or to increase the size of the seal; which, however, would involve an increase in cost attributable to the complicated structure or a reduction in the degree of freedom in design configuration.

Further, in the construction as discussed in Japanese Patent Application Laid-Open No. 2004-306496, at the time of pressurization with air, the pressure is exerted so as to outwardly expand the lip portion 171*a* of the air seal 171. Thus, there is a possibility that the lip portion 171*a* formed of an elastic material gives way under the pressure and is detached from the casing, allowing the pressurization force to escape.

Further, the opening 153 of the ink cartridge 150 is (wide) open, and the ink supply port 167 faces the opening 153 in close proximity thereof (so the ink supply port 167 is not covered). As a result, the user is not prevented from touching the ink supply port 167, so that there is a possibility that the user gets ink on his hand while handling (e.g. attaching or detaching) the ink cartridge 150.

SUMMARY OF THE INVENTION

In an embodiment of the present invention, the seal structure that deforms as a result of the attachment is arranged on the ink cartridge side (so forms part of the ink cartridge).

According to an embodiment of the present invention, there are provided an ink cartridge and an ink jet recording apparatus which achieve an improvement of the degree of freedom in design with respect to the insertion stroke of the ink cartridge and/or an improvement in the handleability of the ink cartridge.

According to an aspect of the present invention, an ink cartridge for supplying ink to a recording apparatus upon connection to the recording apparatus, includes a casing having an interior and an opening, a flexible ink accommodation body, for accommodating ink, provided within the interior of the casing, an ink supply body, attached to the ink accommodation body, for supplying ink in an ink-flow direction from the ink accommodation body to the recording apparatus in the case that the cartridge is connected to the recording apparatus, a first sealing unit, a second sealing unit provided upstream, in the ink-flow direction, of the first sealing unit, wherein the first sealing unit is arranged to retain ink in the ink accommodation body in the case that the cartridge is not connected to the recording apparatus, wherein the second sealing unit is arranged to form a sealing engagement with the recording apparatus when the cartridge is connected to the recording apparatus, and wherein, between the first sealing unit and the second sealing unit, there is provided a gap communicating with the interior of the casing.

According to another aspect of the present invention, an ink jet recording system includes an ink jet recording apparatus connected to an ink cartridge, wherein the ink jet recording apparatus includes an elongate connection member having a proximal end connected to the recording apparatus and a distal end for connection to an ink cartridge, the connection member comprising an air inlet path leading to an air inlet port, for introducing air into the connected ink cartridge, and comprising an ink outlet path leading from an ink outlet port, for introducing ink into the recording apparatus, wherein the ink outlet port is provided at the distal end of the connection member and the air inlet port is provided between the ink outlet port and the proximal end of the connection member, a pump for supplying compressed air to the air inlet path, wherein at least part of the elongate connection member is inserted through the opening of the ink cartridge casing into the ink supply body such that the air inlet port is positioned between the first and second sealing unit and in communication with the interior of the casing via the gap between the first and second sealing unit.

According to yet another aspect of the present invention, an ink jet recording apparatus, arranged to be connected to an ink cartridge, includes an elongate connection member having a proximal end connected to the recording apparatus and a distal end for connection to an ink cartridge, the connection member comprising an air inlet path leading to an air inlet port, for introducing air into the attached ink cartridge, and comprising an ink outlet path leading from an ink outlet port, for introducing ink into the recording apparatus, wherein the ink outlet port is provided at the distal end of the connection member and the air inlet port is provided between the ink outlet port and the proximal end of the connection member, and a pump for supplying compressed air to the air inlet path, wherein the connection member does not comprise an air sealing unit for providing an air-tight seal with the connected ink cartridge.

In an embodiment of the invention there is provided a recording apparatus adopting an air pressurization system and compatible with a large volume ink cartridge and high speed printing, wherein a member which needs to have a sealing property can be replaced together with the ink cartridge (so the sealing member is replaced each time a new ink cartridge is inserted), thereby improving reliability.

Further, in an embodiment of the invention, the seal structure of the ink cartridge which needs to have airtightness with respect to the ink jet recording apparatus, is formed by a combination of radial seals, thereby making it possible to improve degree of freedom in designing the insertion stroke of the ink cartridge.

Further, in an embodiment of the present invention the ink supply port, to which ink may adhere, is arranged internally of the ink cartridge so is not easily touched, thereby improving the handleability of the ink cartridge.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
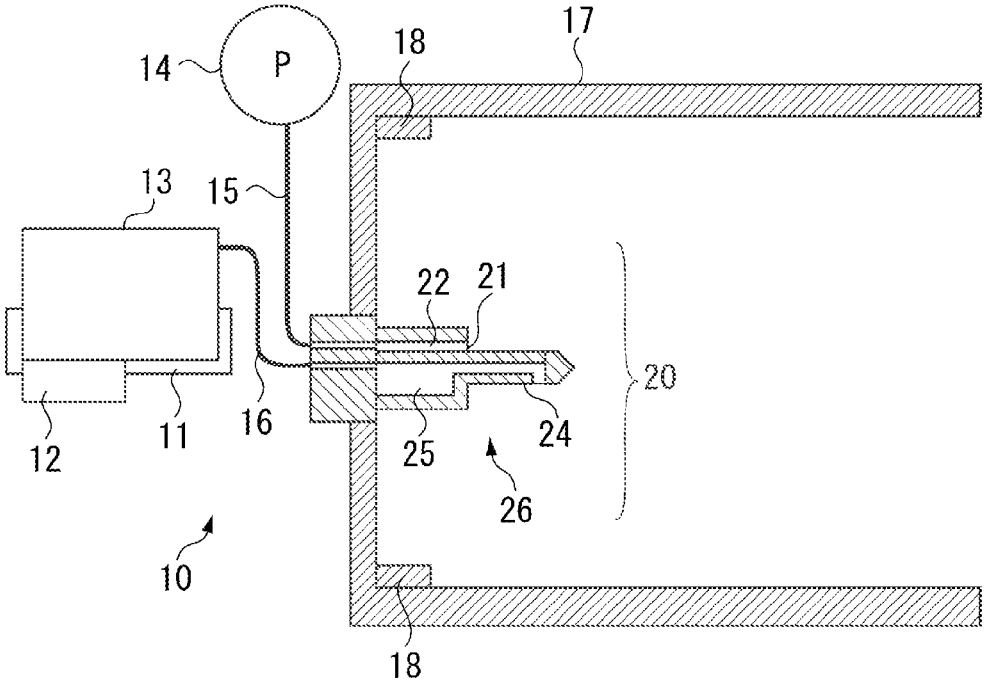
FIG. 1 is a schematic sectional view of an example of the construction of an ink jet recording apparatus to which the present invention is applied.

In the following, a first exemplary embodiment will be illustrated. As illustrated in FIG. 1, an inkjet recording apparatus 10 is equipped with a carriage 11, which is reciprocated in a main scanning direction (i.e., the width direction of a recording sheet) via a timing belt (not illustrated) driven by a motor. A recording head 12 and a sub tank 13 retaining ink supplied from an ink cartridge 50, described below, are mounted on the carriage 11.

Incorporated into the sub tank 13 is a pressure adjustment mechanism (not illustrated) for adjusting the pressure of the ink supplied to the recording head 12. Pressure adjustment at the sub tank 13 is performed for the purpose of mitigating fluctuations in pressure due to shaking of the ink caused by the movement of the carriage 11, and of setting negative pressure to an appropriate range allowing the recording head 12 to perform a satisfactory recording. As the pressure adjustment mechanism, generally a diaphragm valve structure for generating a damper function within, a pressure fluctuation valve, etc. are provided Further, the ink jet recording apparatus 10 is equipped with an attachment portion 17. The ink cartridge 50 is releasably attachable to and detachable from the attachment portion 17. There is arranged a connection member 20 configured to be connected to the ink cartridge 50 when the ink cartridge 50 is attached. The connection member has a proximal end connected to the attachment portion and a distal end, extending from the attachment portion, for connection to the ink cartridge 50. The connection member 20 is equipped with an ink outlet path 25 and an air inlet path 22, which are provided in one pipe body 26. At the distal end of the ink outlet path 25, an ink outlet port 24 is provided; at the distal end of the air inlet path 22, an air inlet port 21 is provided.

On the side of the attachment portion 17 where the connection member 20 is arranged, a stopper 18 determining the depth position with respect to the inserting direction at the time of attachment of the ink cartridge is provided. As a result, at the time of attachment of the ink cartridge 50 to the attachment portion 17, the ink cartridge 50 abuts the stopper 18, thus determining the ultimate attachment position of the ink cartridge with respect to the abutment attaching direction.

The ink outlet port 24 of the connection member 20 is connected via the ink outlet path 25 to an ink tube 16 connecting to the sub tank 13 of the recording head 12 and constituting an ink path for supplying ink. The air inlet port 21 of the connection member 20 is connected via the air inlet path 22 to an air tube 15 constituting an air path connecting to an air pump 14 generating pressurization air for sending ink under pressure from the ink cartridge 50 to the sub tank 13. The air pump 14 is equipped with a pressure sensor and a pressure adjustment valve (which are not illustrated) for controlling pressure.

The base (proximal) portion of the pipe body 26 constituting the connection member 20 has a relatively large diameter; the portion of the pipe body extending beyond the air inlet port 21 at the distal end of the air inlet path 22 is formed one step slimmer (so has a smaller diameter than the base portion), extending as a part of the ink outlet path 25.

Next, the construction of the ink cartridge 50 of the present exemplary embodiment will be illustrated with reference to FIG. 2.

The ink cartridge 50 includes as main components an ink accommodation body 61 accommodating ink 40, a spout 62 connected to the ink accommodation body 61, and a casing 51 housing the ink accommodation body 61. The spout 62 is a member for providing the ink accommodation body 61 with an ink supply port 67 for supplying the ink 40 to the ink jet recording apparatus 10. An ink seal (which is sometimes referred to as the first seal for the sake of convenience) 63, a valve 64, and a spring 65 are incorporated into the ink supply port 67 provided in the spout 62.

The valve 64 is arranged so as to be pressed against the ink seal 63 by the spring 65, and the ink seal 63 is mounted to the spout 62 by a cap 66 for preventing detachment. The ink seal 63 is of an annular structure with its center open, and the outer peripheral portion thereof is held in intimate contact with the spout 62, thereby securing airtightness between the ink seal 63 and the spout 62. On the ink accommodation body 61 side of the ink seal 63, there is provided a lip-like protrusion 63*a* so as to surround the opening to effect firm sealing when it abuts the valve 64.

The spout 62 is further equipped with an engagement portion 62*a*, which is engaged with a pair of regulation members 55 provided in the casing 51 to position and fix an ink bag unit 60 with respect to the casing 51.

For the sake of convenience, the structure equipped with the spout 62, the engagement portion 62*a* of the spout, the ink seal 63, the lip-like protrusion 63*a*, the valve 64, the spring 65, and the cap 66 will be referred to as an ink supply body 68. The structure obtained by assembling the ink supply body 68 and the ink accommodation body 61 to each other will be referred to as the ink accommodation body unit 60.

By thus holding the ink seal 63 in intimate contact with the spout 62 and pressing the valve 64 firmly against the ink seal 63, it is possible to cut off communication between the interior and exterior spaces of the ink accommodation body unit 60. Due to this construction, it is possible to suppress ink leakage from the interior of the ink accommodation body unit 60 and ink degeneration due to evaporation or the like. The ink seal 63 is formed of a flexible material, for example, a rubber material such as a butyl rubber, or a thermoplastic resin material such as elastomer.

The ink bag (ink reservoir) 61 of the present exemplary embodiment is formed by superimposing two oblong flexible film materials one upon the other and fusing the edges of three sides thereof to bond them together. The spout 62 is inserted into the remaining one, which is an unfused side, and fusing is effected on the films to thereby form the ink accommodation body unit 60.

Specifically, the sheet material constituting the ink accommodation body 61 is preferably formed by sequentially stacking a polyethylene terephthalate layer, an adhesion layer, an aluminum alloy layer, an adhesion layer, a nylon layer, an adhesion layer, and a polypropylene layer (inner surface layer) in this order. In this way, by arranging an aluminum alloy layer as an intermediate layer, it is possible to cut off transmission of a gas through the ink bag, making it possible to prevent evaporation of the ink. Further, by adding nylon to the layer structure, it is possible to achieve an improvement in prevention of perforation in the films due to bending and rubbing. Like the inner surface layer, the spout is also formed of a material whose main ingredient is polypropylene, which excels in ink resistance, so that it is possible to fuse and bond the spout and the ink bag, making it possible to effect sealing free from leakage.

Figure 3:
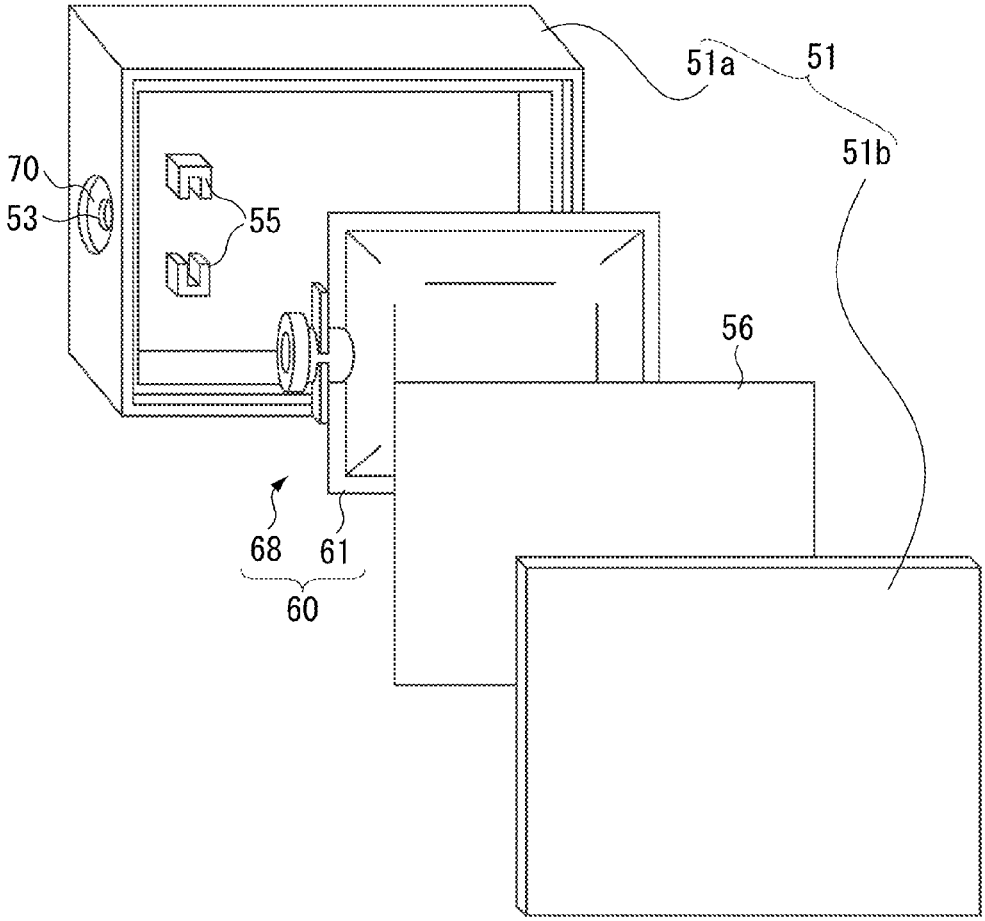
FIG. 3 is an exploded perspective view of the ink cartridge to which the present invention is applied.

As illustrated in FIG. 3, to form the ink cartridge 50 the ink accommodation body unit 60 is fixed to a container body 51*a*, which is of a flat outer configuration and whose one side surface constituting a maximum area surface is open (so three sides of container body are closed but a largest side of the container body is open, forming an opening), by mounting and fixing the engagement portion 62*a* of the spout 62 to the regulation members 55 as described above. Further, a film 56 covering the opening of the container body 51*a*, and a cover member 51*b* covering the opening of the container body 51*a*, are put together, in this order, to form the ink cartridge. As the film 56, a fusion bonding layer of the same material is adopted as the container body 51*a*. In the present exemplary embodiment, the hermetic film (56) is formed of a polyethylene terephthalate layer, an adhesion layer, and a polypropylene layer. The container body 51*a* and the cover member 51*b* corresponding thereto are also formed by using polypropylene as the main material. If the film 56 were to be left exposed (so not covered), there is a possibility that a hole could be made during transport or handling thereof; further, when pressurization is effected in the interior, the film undergoes deformation through expansion; in view of this, the cover member 51*b* serves to protect the film 56 and to suppress deformation thereof.

The method of hermetically sealing the opening of the container body 51*a* is not restricted to the one described above; it is also possible to adopt a method in which the hermetic structure is formed through vibration fusion bonding or the like; thus, any other suitable method may be adopted as appropriate.

The method of the present exemplary embodiment adopting film fusion bonding is desirable in that the ink bag is not affected by the vibration at the time of mounting the cover or the like, thereby making it possible to reduce the possibility of ink leakage.

Figure 2:
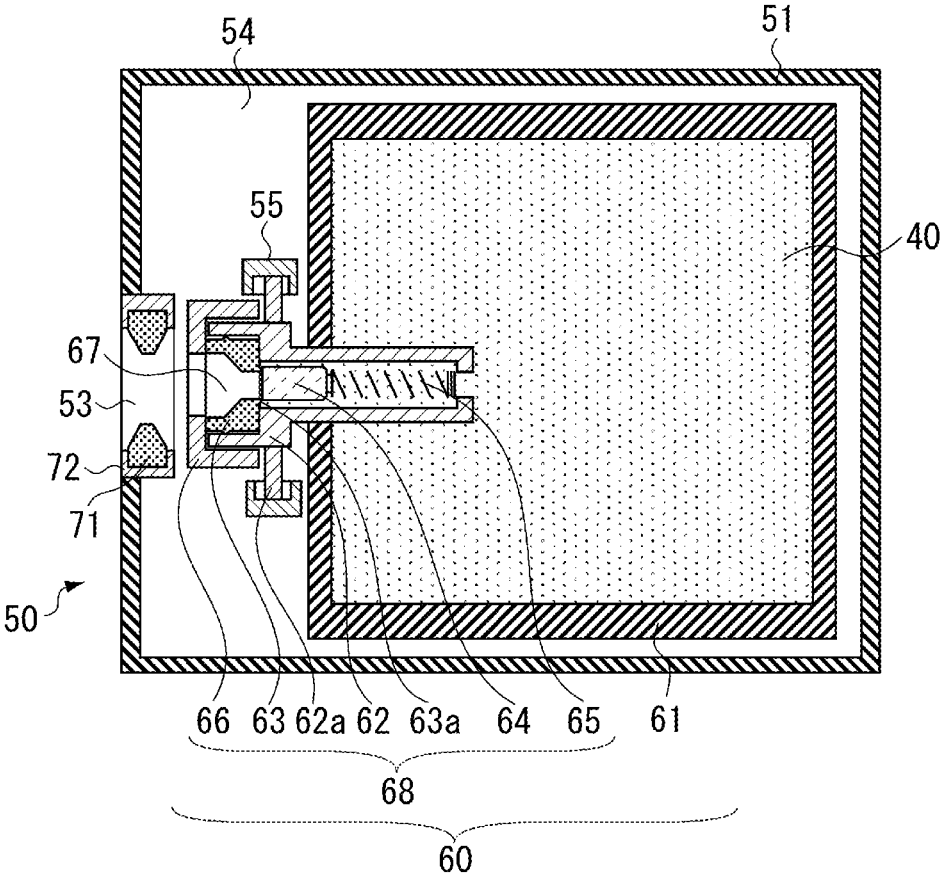
FIG. 2 is a schematic sectional view of an example of the construction of an ink cartridge to which the present invention is applied.

Referring to FIG. 2 the casing 51 has an opening 53 at a position corresponding to the ink supply port 67 of the spout 62. An air seal (which is sometimes also referred to as the second seal for the sake of convenience) 71 is provided at the opening 53; the air seal 71 is of an annular structure whose center is open; its outer periphery is held in contact with the casing 51, thereby effecting sealing with its outer peripheral portion. For the purpose of detachment prevention, the air seal 71 is mounted to the casing 51 by an air seal cover 72 whose center is open. The first seal 63 and second seal 71 are separate from each other and have a gap between them which is in communication with the interior 54 of the casing. In particular the gap enables fluid communication (e.g. air to flow) between the opening 53 and the interior of the casing 54.

Due to the above construction, the ink cartridge 50 is hermetically sealed except for the opening of the air seal 71.

Figure 4:
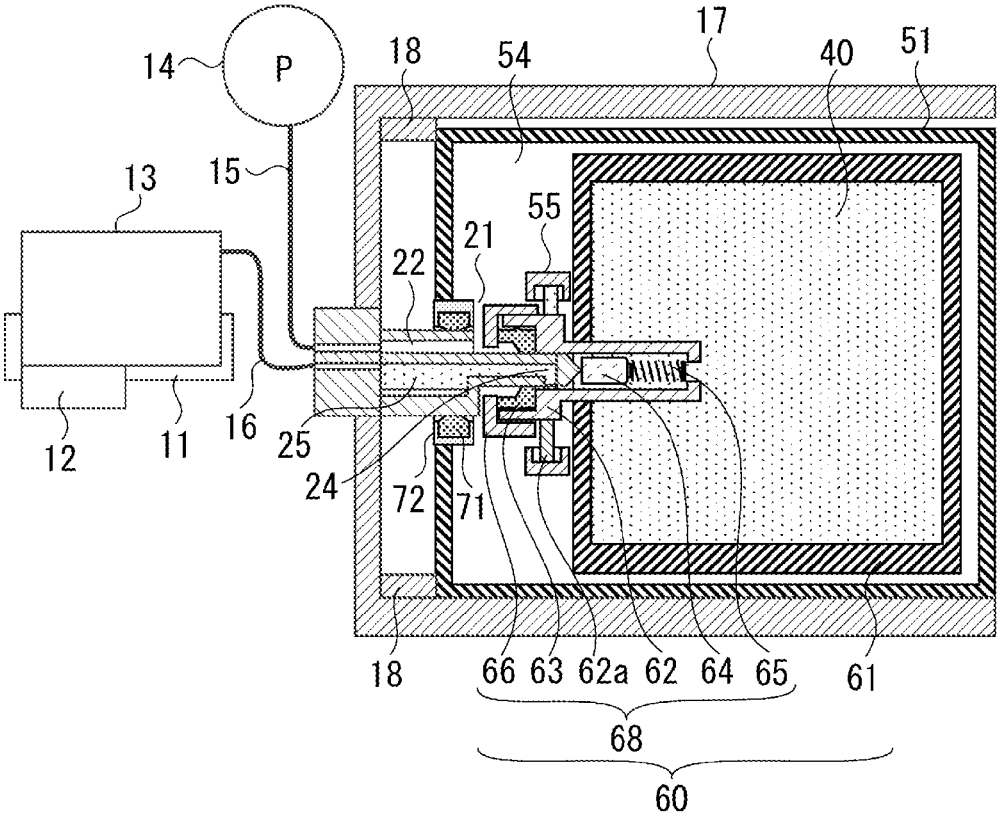
FIG. 4 is a schematic sectional view of the ink cartridge illustrated in FIG. 2 as attached to the ink jet recording apparatus illustrated in FIG. 1.

FIG. 4 illustrates the ink cartridge 50 illustrated in FIG. 2 as attached to the ink jet recording apparatus 10 illustrated in FIG. 1.

When the ink cartridge 50 is attached to the ink cartridge attachment portion 17 of the recording apparatus 10, the ink outlet path 25 of the pipe body 26 and the ink outlet port 24 provided near the distal end thereof first pass the hole of the air seal 71 to enter the ink cartridge 50. Subsequently, the air inlet port 21 reaches the air seal 71. The pipe body 26 is formed to be slightly larger than the inner diameter of the air seal 71, so that the pipe body 26 is inserted while outwardly expanding the air seal 71, with the result that the outer periphery of the pipe body 26 is sealed by the air seal 71.

The ink outlet path 25 of the pipe body 26 having passed the air seal 71 is inserted into the ink supply port 67 formed in the ink cartridge 50. As is the case with the air seal 71, the outer peripheral portion of the pipe body 26 constituting the ink outlet path 25 is inserted while expanding the ink seal 63 to abut the valve 64. By thus expanding the ink seal 63, sealing property is secured between the pipe body 26 equipped with the ink outlet path 25 and the ink seal 63.

When, in this state, the ink cartridge 50 is further pushed in, the valve 64 is pushed into the interior of the ink accommodation body unit 60 by the pipe body 26, and the ink outlet port 24 provided near the distal end of the ink outlet path 25 is connected with the ink 40 within the ink accommodation body 61. The pushing-in of the ink cartridge 50 is regulated by the stopper 18 provided in the attachment portion 17, making it impossible to perform further pushing-in.

More specifically, the air seal 71 is arranged on the upstream side, and the ink seal 63 is arranged on the downstream side with respect to the insertion/extraction route for the ink cartridge 50 with respect to the connection member 20.

As described above, when the ink cartridge 50 is attached to the ink jet recording apparatus 10, a space portion 54 inside the ink cartridge 50 is defined as an airtight chamber by the pipe body 26 and the air seal 71, and the ink accommodation body unit 60 exists within the space portion 54.

Due to this construction, the pressure applied to the ink 40 in the ink accommodation body unit 60 and the pressure applied to the ink supply port 67 can be made equal to each other. Thus, there is no need to design the pipe body 26 constituting the ink outlet path 25 and the sealing property of the ink seal 63 to be capable of withstanding the pressurization force, making it possible to enhance the reliability of ink leakage.

An example of the ink supply operation with this construction is carried out by the following steps. Air is supplied from the air pump 14 to the space portion 54 formed as an airtight chamber inside the cartridge 50. The interior of the ink cartridge 50 is pressurized by the air supplied to the space portion 54, and the ink accommodation body unit 60 is also pressurized. The ink 40, which has been pressurized through the pressurization of the ink accommodation body unit 60, passes through the ink outlet port 24 formed in the ink outlet path 25, and is supplied to the sub tank 13 mounted on the carriage 11 via the ink tube 16.

The ink is supplied to the recording head 12 via the sub tank 13, and is ejected through a plurality of ink discharge nozzles provided in the recording head 12.

The adjustment of this pressurization is performed by a pressure adjustment valve and a pressure detector arranged within the air pump 14. When the pneumatic pressure due to the pressurization attains a level beyond a predetermined value, the pressure adjustment valve releases the pressure. Specifically, a structure such as an air valve using a spring is adopted, in which the pressure can be set by the spring force. Due to this pressure adjustment valve, it is possible to prevent damage caused by an excessive pressure applied to the ink cartridge 50 and the air tube 15 of the ink jet recording apparatus 10.

The pneumatic pressure due to the pressurization is detected by the pressure detector, and, based on a signal from it, drive control is performed on the air pump in the recording apparatus. The pressurizing operation is started by the air pump from the atmospheric pressure; when it is detected that the airtight chamber has attained a predetermined pressure, the driving of the air pump is stopped. Conversely, when the pressure in the airtight chamber has been reduced to a level below the predetermined pressure, the pressurizing operation by the air pump is started to perform the drive to enhance the pressure. By repeating the above steps, the pressurization amount for the ink cartridge is maintained within a predetermined range.

As described above, in the ink cartridge of the present invention, the seal member, the ink seal, and the air seal, which are required to maintain airtightness, are provided on the ink cartridge side, so that the seal member, to which deforming stress is applied, can be renewed through replacement of the ink cartridge.

Further, the sealing between the ink seal and the air seal and the pipe body of the recording apparatus is effected through peripheral contact between the inner peripheral surfaces of the ink seal and of the air seal and the outer peripheral surface of the pipe body, so that it is possible to secure a stable sealing property with respect to the stroke of the ink cartridge (so to achieve a stable seal on insertion of the ink cartridge).

Further, the ink seal is arranged on the inner side of the air seal arranged on the outer side of the casing, and the air seal is expanded when it abuts the air inlet cylinder at the time of insertion of the recording apparatus, so that, when the ink cartridge exists alone (so is not connected to a recording apparatus), the opening diameter of the seal is small.

As described above, it is very difficult to touch the ink supply port from the outside of the ink cartridge, so that the inconvenience of the user soiling his hand while handling the ink cartridge can be suppressed.

Further, in the present construction, which adopts an air/ink connection unit formed by combining the air inlet port and the ink outlet port into one component, the component construction is simplified, making it possible to achieve a reduction in the cost of the recording apparatus.

The construction of the pipe body 26 of the ink jet recording apparatus 10 is not restricted to that of the present exemplary embodiment, and various modifications are possible within a range in which the advantage of the present invention is to be expected.

While in the above exemplary embodiment the ink supply port adopts a construction composed of an ink seal, a valve, and a spring, it is also possible to adopt a needle/rubber system which employs a needle with a sharp distal end, which is directly pierced into a compressed rubber member.

Further, the material of the innermost film layer of the ink bag and of the spout is not restricted to polypropylene but can be selected as appropriate. For example, by employing polyethylene, it is possible to form a structure resistant against low temperature shock. Of course, for the film layer construction, it is possible to select a desired construction as appropriate according to the ink characteristics.

The construction of an ink jet recording apparatus and an ink cartridge according the second exemplary embodiment will be described in their attached state with reference to FIGS. 5 through 7.

The present exemplary embodiment differs from the first exemplary embodiment, in particular, in the construction of an ink supply body 68 and of a seal 80. The following description will concentrate on the structural differences from the first exemplary embodiment.

Figure 5:
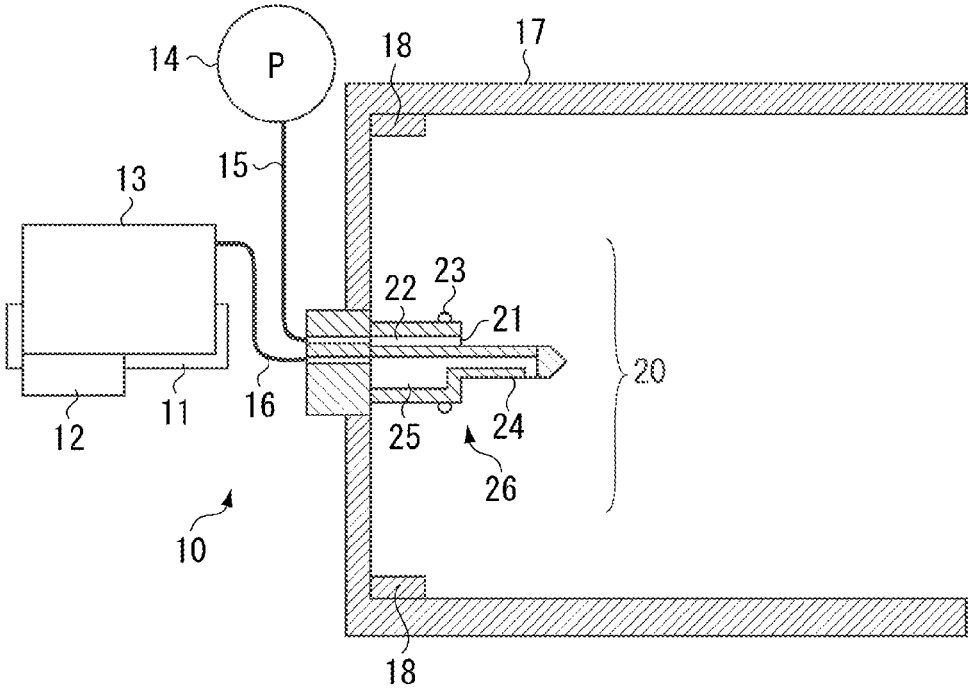
FIG. 5 is a schematic sectional view of another example of the construction of an ink jet recording apparatus to which the present invention is applied.

As illustrated in FIG. 5, the connection member 20 of the ink jet recording apparatus is equipped with a rib-like protrusion 23 in the periphery of the pipe body 26 constituting the connection member. This corresponds to (engages with) the structure of a spout 62 and a seal 80 of the ink supply body 68 of the ink cartridge 50 described with reference to FIG. 6; it is a structure that serves, in particular, to secure reliability in air sealing property.

Figure 6:
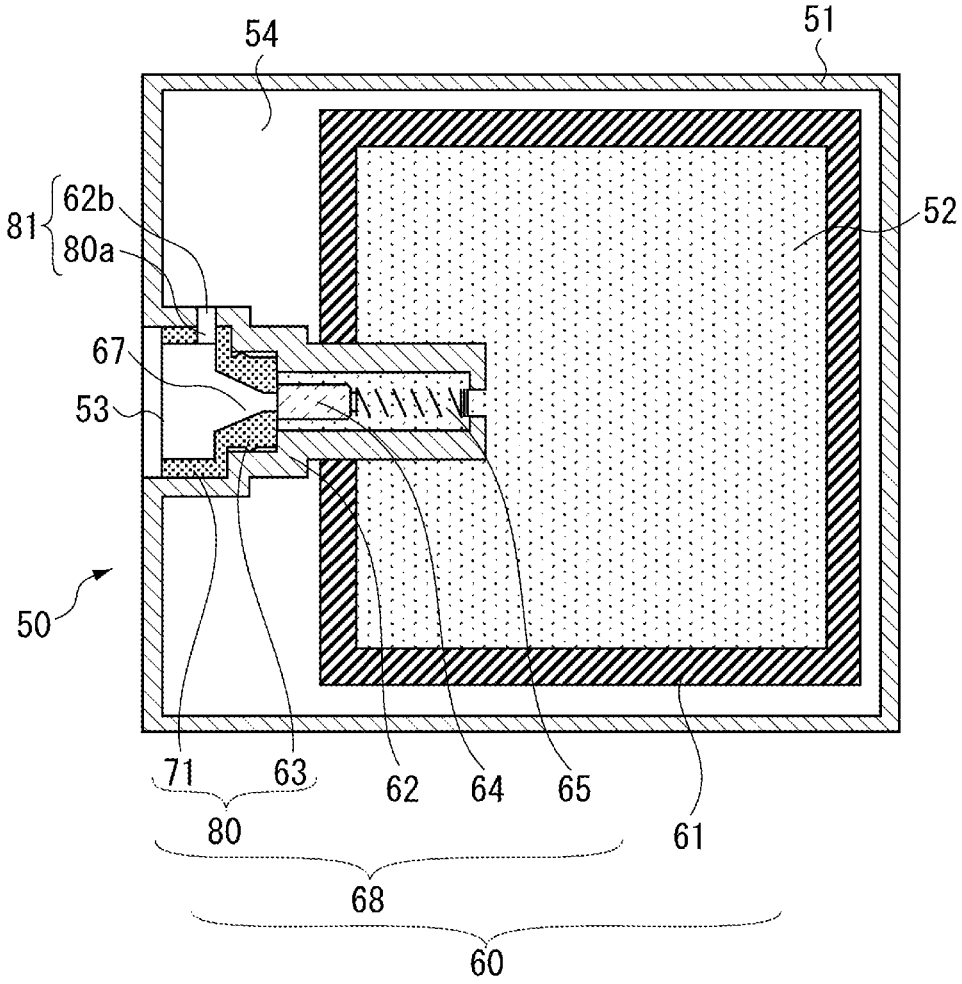
FIG. 6 is a schematic sectional view of another example of the construction of an ink cartridge to which the present invention is applied.

FIG. 6 illustrates the construction of the ink cartridge 50. The spout 62 of the ink cartridge 50 is integrally equipped with both an air seal region and an ink seal region, and is directly disposed adjacent to the casing 51. Inside the spout 62, there is arranged the seal 80, which is formed by integrating the ink seal 63 (the first seal) and the air seal 71 (the second seal). The spout 62 and the seal 80 are formed in conformity with the construction of the pipe body 26 of the connection member 20 of the inkjet recording apparatus 10; the ink seal 63 and the air seal 71 are formed in (with) different diameters, with a step therebetween. The air seal 71 has a larger diameter (one step larger) than the diameter of the ink seal 63, and extends in a tubular fashion to be brought into intimate contact with the rib-like protrusion 23 of the pipe body 26 in a peripheral direction.

A seal communication port 80*a* is provided between the air seal 71 and the ink seal 63 of the seal 80, and a spout communication port 62*b* is provided between the air seal region and the ink seal region of the spout 62. These communication ports are provided to fit in each other (align with each other), forming an air communication port 81 for introducing the pressurized air sent from the air inlet port 21 of the ink jet recording apparatus 10 into the casing 51. So the seal communication port 80*a* forms a gap, between the first and second seals, in communication with the interior of the casing. In particular the communication port 80*a* enables fluid communication (e.g. air to flow) between the opening 53 and the interior 54 of the casing.

While the spout 62 and the casing 51 may be formed as separate components, they may also be integrated with each other. The integration helps to simplify the structure for mounting, and is more desirable from the viewpoint of production. In this case, it is possible, for example, to open both sides of the casing, and to attach the films for forming the ink bag to the spout portion from the right and left sides of the casing, thus preparing the ink bag unit directly inside the casing.

Figure 7:
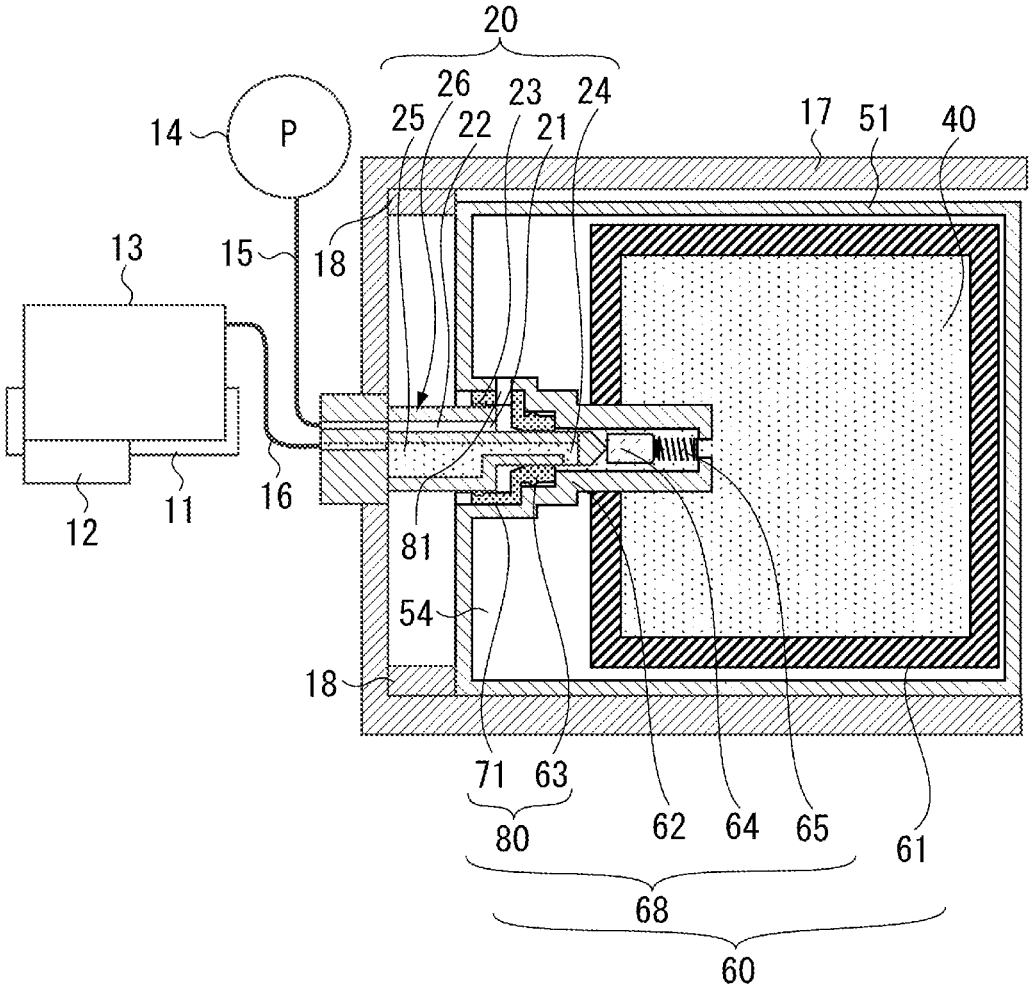
FIG. 7 is a schematic sectional view of the ink cartridge illustrated in FIG. 6 as attached to the ink jet recording apparatus illustrated in FIG. 5.

FIG. 7 illustrates the ink cartridge 50 as attached to the ink jet recording apparatus 10 as described above. In particular, the air seal 71 of the ink cartridge 50 is outwardly expanded by the rib-like protrusion 23 of the inkjet recording apparatus, thereby securing the sealing property therebetween. In this way, the opening 53 of the ink cartridge 50 is hermetically sealed, forming the airtight space portion 54 within the casing 51 of the ink cartridge 50.

When the attachment is completed, the air inlet port 21 communicates with the air communication port 81, and the pressurized air sent from the air inlet port 21 is sent into the airtight space portion 54 via the air communication port 81.

With the construction of the present exemplary embodiment, it is possible to achieve a reduction in cost through a reduction in the number of seal members and to achieve an improvement in assembly property.

In this construction example, the rib-like protrusion 23 is arranged on the pipe body 26 constituting the connection member 20 of the ink jet recording apparatus 10, whereby there is no need to provide a protrusion rib on the inner peripheral surface of the air seal 71 of the ink cartridge 50 and the inner peripheral surface can be formed as a flat surface. In the construction in which the protrusion rib is provided on the inner peripheral surface of the air seal 71, a forced extraction is required in the processing, whereas, in the present construction example, there is no need for that, so that it is possible to achieve integration of the components without sacrificing moldability.

Figure 8:
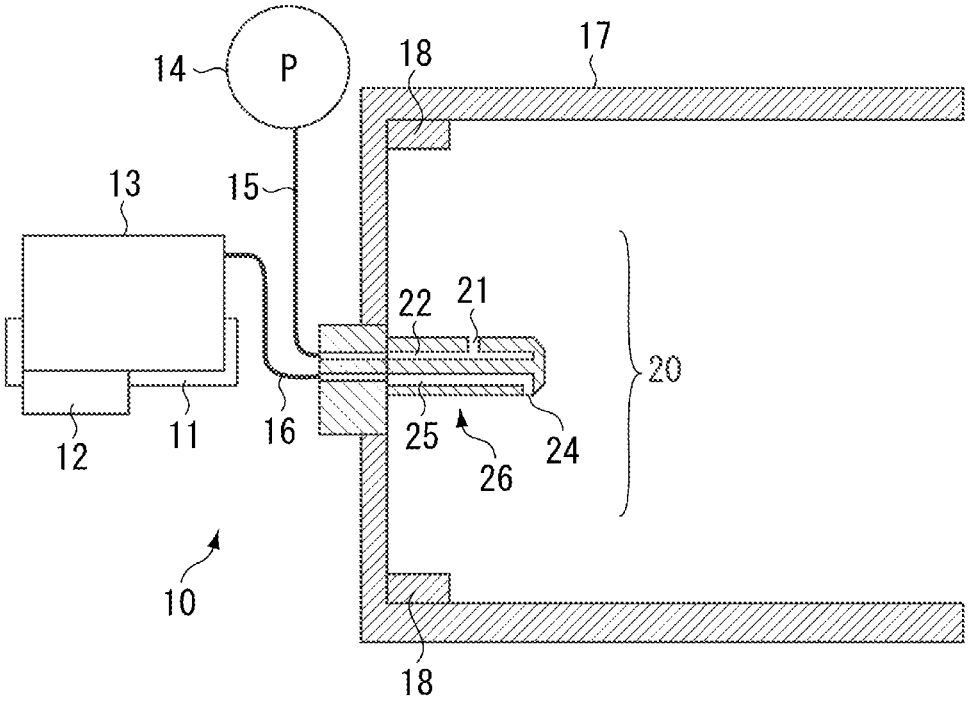
FIG. 8 is a schematic sectional view of yet another example of the construction of an ink jet recording apparatus to which the present invention is applied.

A third exemplary embodiment will be described with reference to FIGS. 8, 9, and 10. As illustrated in FIG. 8, the present exemplary embodiment differs from the other exemplary embodiments in that the connection member 20 arranged in the ink jet recording apparatus 10 and equipped with the ink outlet port 24, the ink outlet path 25, the air inlet port 21, and the air inlet path 22 is formed by a pipe body 26 of a uniform diameter. The ink outlet port 24 of the ink outlet path 25 provided in the pipe body 26 of a uniform diameter is open in the side surface of the pipe body 26 in the vicinity of the distal end thereof, and the air inlet port 21 of the air outlet path 22 is open in a mid portion of the side surface of the pipe body 26.

Figure 9:
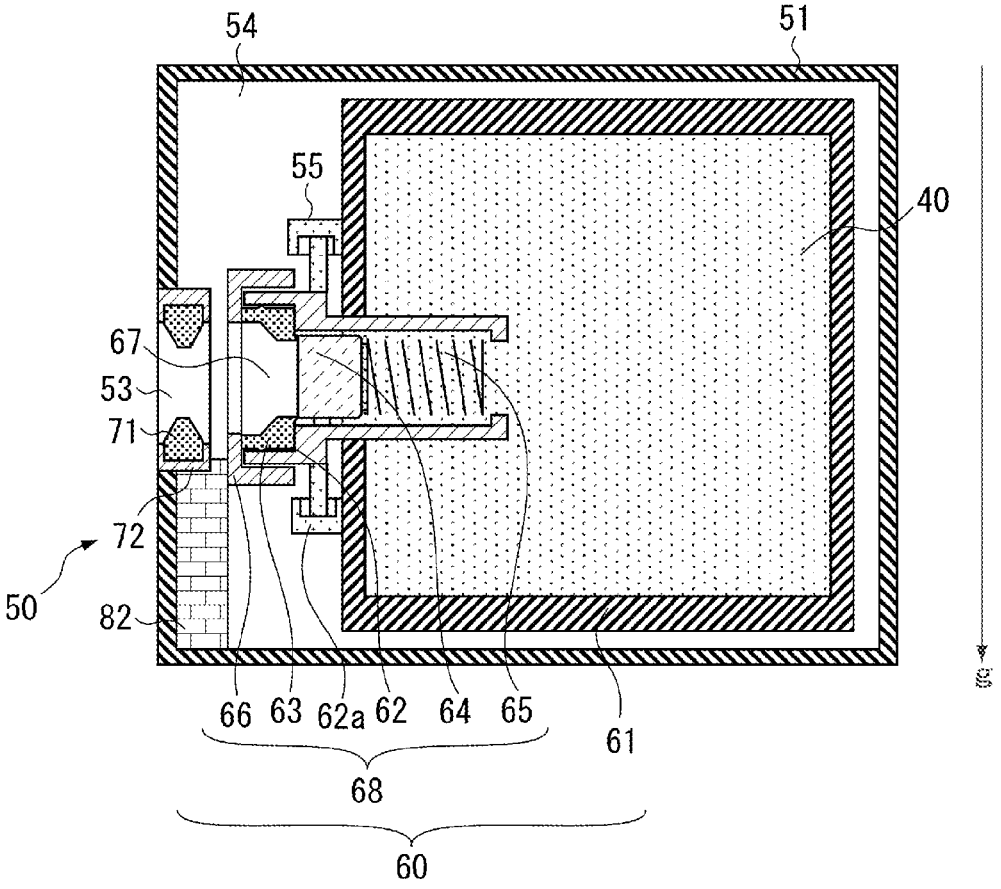
FIG. 9 is a schematic sectional view of yet another example of the construction of an ink cartridge to which the present invention is applied.

Furthermore, as illustrated in FIG. 9, as in the first exemplary embodiment, the ink cartridge 50 adopts the construction in which the ink accommodation body unit 60, formed through combination of the ink supply body 68 and the ink accommodation body 61, is arranged inside the casing 51, and the casing 51 is provided with the air seal 71. However, in the pipe body 26 of the connection member 20 inserted into the ink cartridge 50, a portion where the ink inlet port 21 is provided and a portion where the ink outlet port 24 is provided, are of the same diameter, so that the air seal 71 and the ink seal 63 abutting the pipe body 26 are of approximately the same opening size. In the present exemplary embodiment, an ink absorption body 82 for absorbing and retaining ink is arranged within the space portion 54 so as to be in contact with the space between the air seal 71 and the spout 62. As illustrated in FIGS. 10A through 10D, the ink absorption body 82 is configured to recover ink by wiping off the ink adhering to the periphery of the ink outlet port 24 or the ink leaking from the ink outlet port 24 by the air seal 71 when removing the ink cartridge 50 from the attachment portion 17. The ink absorption body 82 is arranged under the air seal 71 in the gravity direction (indicated by the arrow g in FIG. 9) in the state in which the ink cartridge 50 is attached to the attachment portion 17. Due to this construction, it is possible to receive and recover the ink leaking from the pipe body 26 or dripping by gravity after having been wiped off by the air seal 71.

The operation and behavior when detaching the ink cartridge from the ink jet recording apparatus will be described with reference to FIGS. 10A through 10D.

Figure 10A:
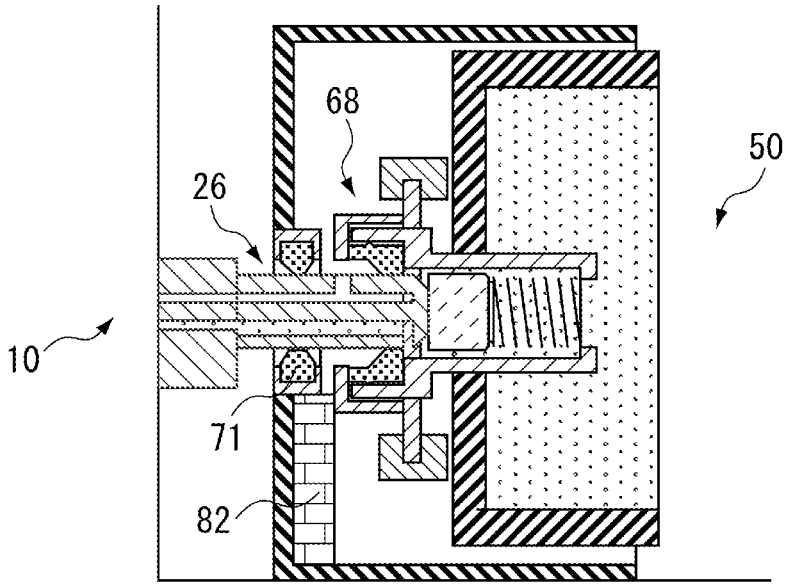
FIG. 10A is a schematic sectional view of a main portion with an ink cartridge attached thereto.

FIG. 10A illustrates the ink cartridge 50 as attached to the recording apparatus 10; in this state, the ink outlet port 24 communicates with the ink 40 in the ink bag, and the air inlet port 21 communicates with the space portion 54 of the casing 51 (see also FIG. 2). When pressurized air is sent in this state, ink is supplied.

Figure 10B:
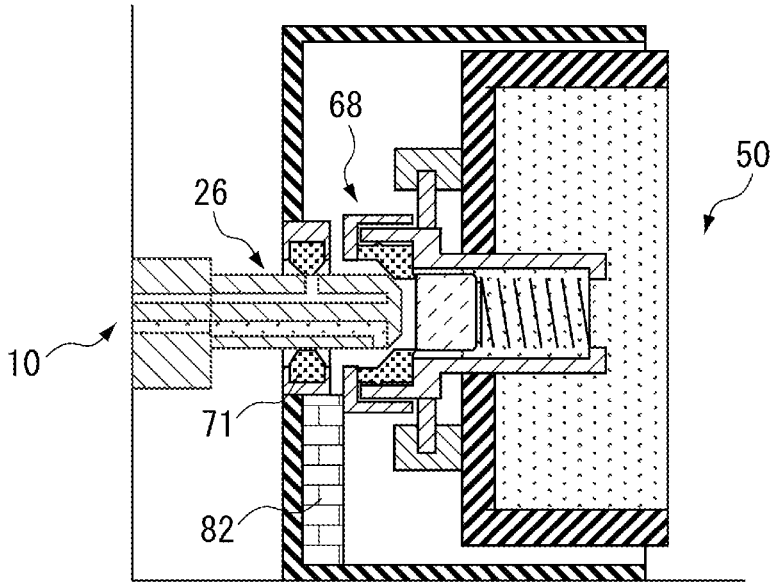
FIG. 10B is a schematic sectional view of the main portion when the ink cartridge starts to be detached.

FIG. 10B illustrates the ink cartridge 50 which is starting to be detached from the recording apparatus 10; in this state, the valve 64 of the ink supply body 68 abuts the ink seal 63, and the communication between the ink 40 in the ink accommodation body 61 and the ink outlet port 24 is cut off. In this state, waste ink 41 not to be used for recording adheres to the periphery of the distal end region of the pipe body 26, which has been in contact with the ink 40 (FIG. 10B does not illustrate the waste ink adhering to the periphery of the pipe body 26, see also FIG. 2).

Figure 10C:
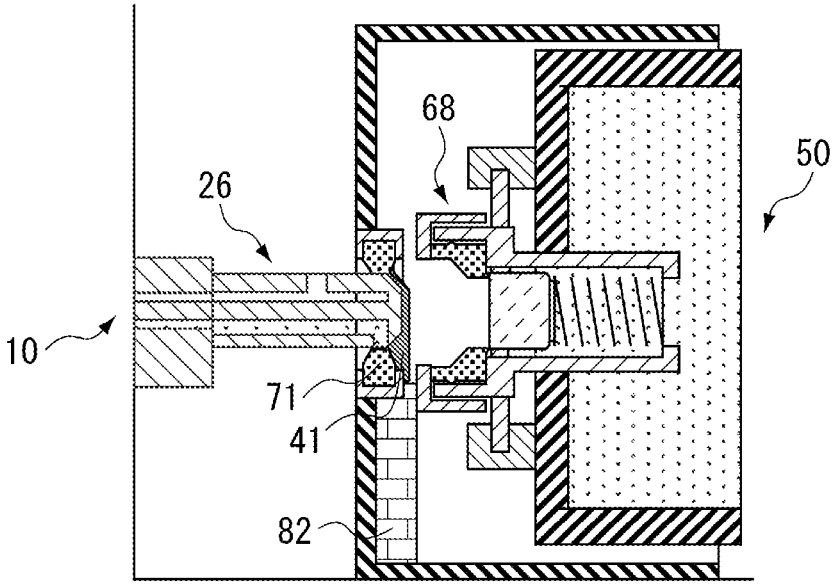
FIG. 10C is a schematic sectional view of the main portion when the ink cartridge is being detached.
Figure 10D:
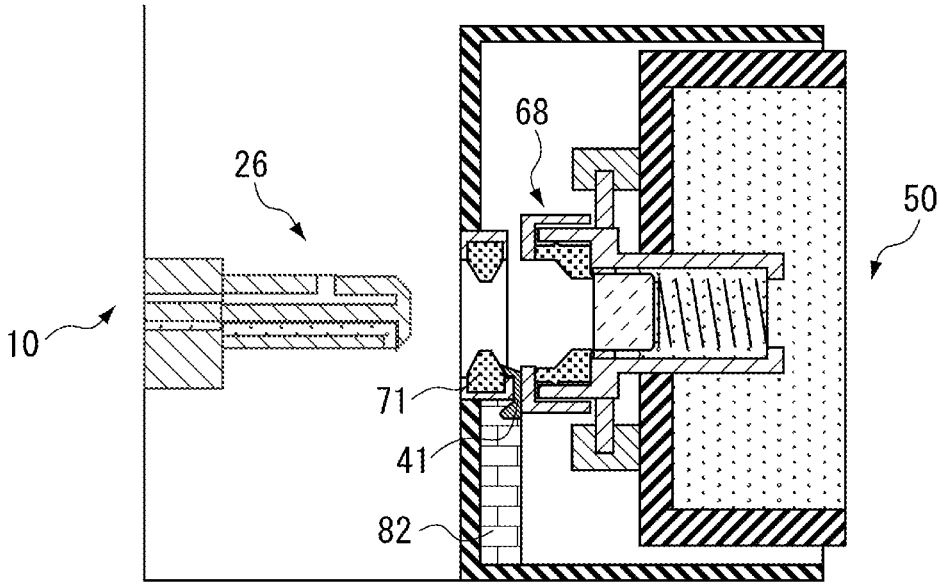
FIG. 10D is a schematic sectional view of the main portion when the detachment of the ink cartridge is completed.
Figure 11:
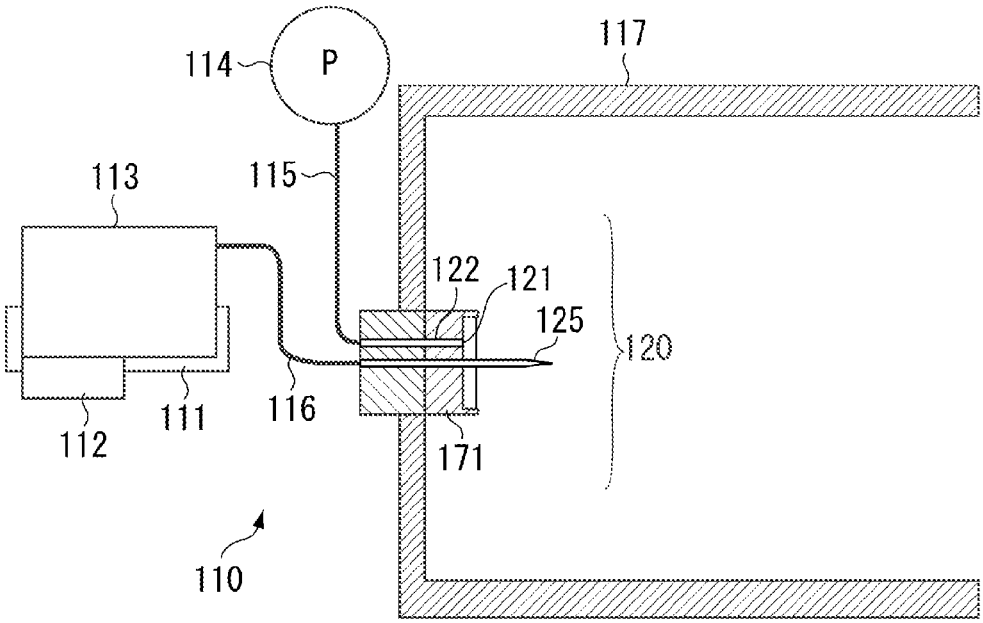
FIG. 11 is a schematic sectional view of an example of the construction of a conventional recording apparatus.
Figure 12:
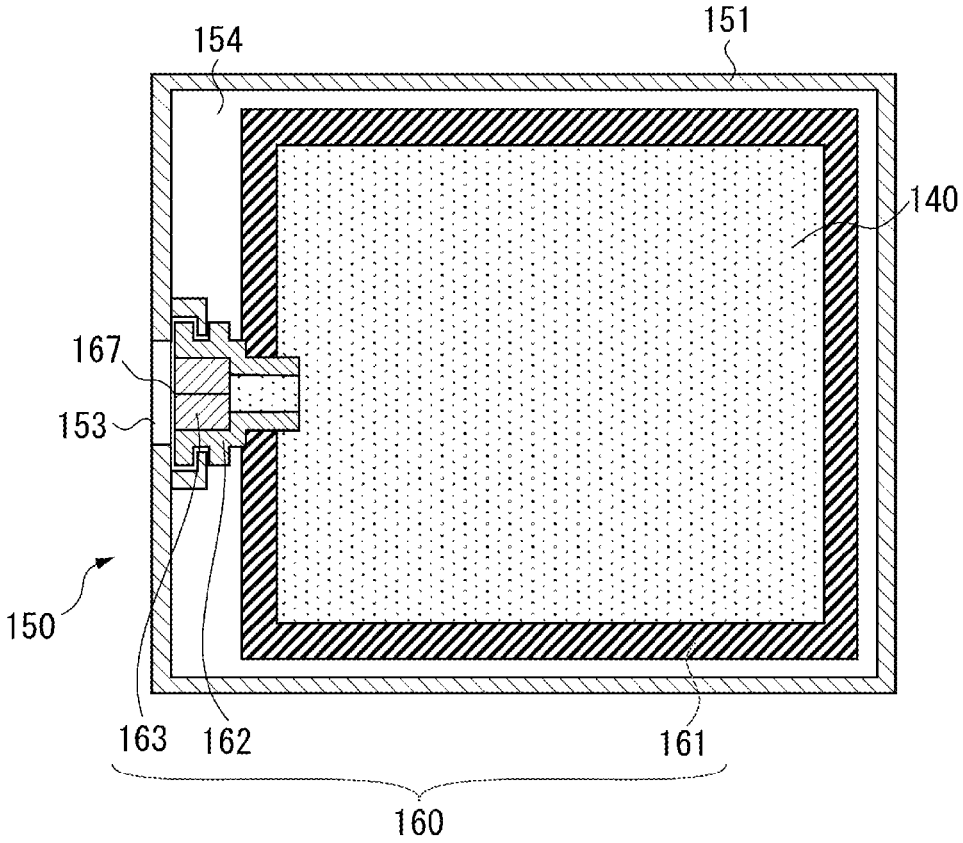
FIG. 12 is a schematic sectional view of an example of the construction of a conventional ink cartridge.
Figure 13:
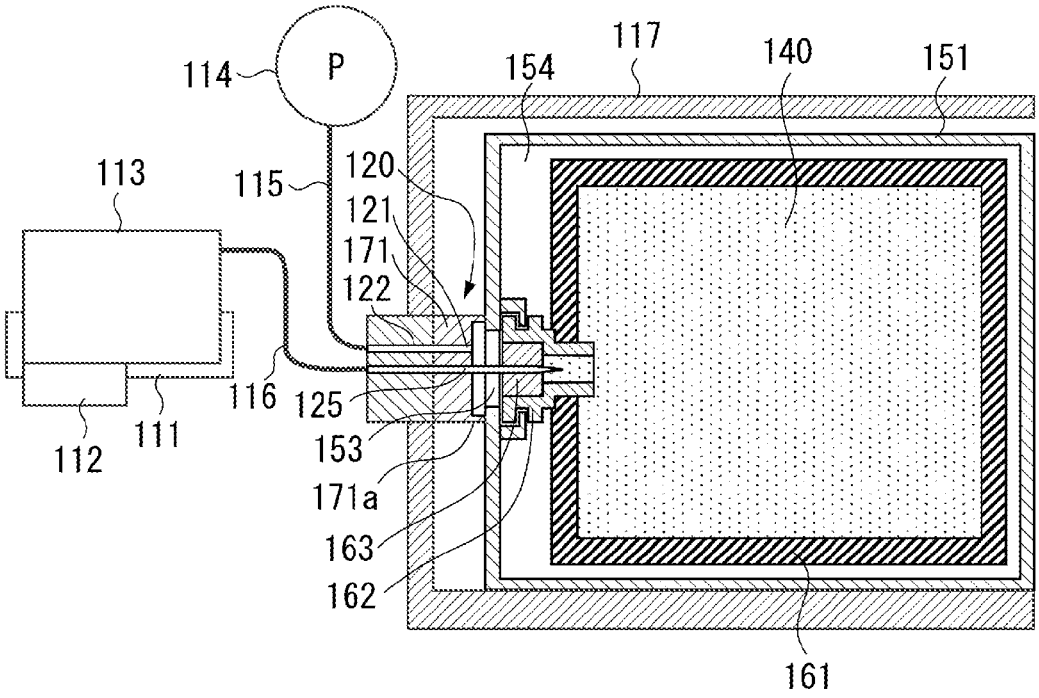
FIG. 13 is a schematic sectional view of the ink cartridge illustrated in FIG. 12 as attached to the ink jet recording apparatus illustrated in FIG. 11.

As illustrated in FIG. 10C, when the operation of extracting the ink cartridge is further continued, the pipe body 26 and the air seal 71 are rubbed against each other, whereby the waste ink 41 that is adhering to the periphery of the pipe body 26 is squeezed (wiped), and is gradually collected at the distal end side of the pipe body 26. As illustrated in FIG. 10D, the collected waste ink moves from the air seal 71 to the ink absorption body 82 arranged below in the gravity direction of the seal and is recovered to be retained in the casing 51. As a result, a reduced amount of ink adheres to the air seal 71, so that the possibility that ink adheres to the user handling the detached ink cartridge 50 can be reduced. The operation of detaching the ink cartridge may be performed not only when an ink end warning is given to the user but also during use of the ink cartridge; in this case also, the amount of ink staying in the periphery of the ink supply port is reduced, so that the possibility of soiling with ink is reduced.

In this way, when detaching the ink cartridge, the distal end portion of the pipe body 26 equipped with the ink outlet port 24 is pulled out while in contact with the air seal 71. As a result, the pipe body can always be kept clean, so that it is possible to avoid the inconvenience which would arise when the ink adhering to the pipe body 26 is dried and solidified.

Further, the ink wiped off into the ink cartridge is replaced together with the ink cartridge, so that there is no possibility that the wiped off ink overflows in the interior of the recording apparatus to cause a problem.

In the present exemplary embodiment described above, an absorption body is arranged inside the ink cartridge, whereby the ink wiped off into the ink cartridge is retained in a stable manner. However, since the diameter of the ink outlet port 24 portion of the pipe body 26 is equal to the inner diameter of the seal 71, it is possible to benefit from the wiping-off effect thanks to the seal, which is significant in this construction. The ink absorption body 82 arranged inside the casing proves effective in disposing of the wiped off ink; however, it is not an indispensable feature. Namely, the ink wiping-off effect is occurs even if the absorption body 82 is not provided.

The present invention also provides an ink cartridge (50) which is equipped with a casing having an opening, a flexible ink accommodation body provided within the casing and accommodating ink, and an ink supply body attached to the ink accommodation body and related to ink supply, and which is detachable from a connection member (20) provided in a recording apparatus and configured to perform ink supply through introduction of air between the casing and the ink accommodation body with the attached ink supply body and the connection member (20) connected to each other, wherein a first seal is provided on the downstream side and a second seal is provided on the upstream side, of an insertion/extraction path of the connection member (20) of the ink cartridge (50), wherein the first seal is brought into peripheral contact with the connection member (20) to effect sealing in a region between an ink outlet port (24) provided at the distal end side of the connection member (20) and an air inlet port (21) provided between the ink outlet port (24) and a base portion of the connection member (20) and configured to introduce air from the exterior into the ink cartridge (50), wherein the second seal is formed to seal the connection member (20) by coming into contact with the connection member (20) in the region between the air inlet port (21) and the base portion of the connection member (20), and wherein, between the first seal and the second seal, there is provided a gap communicating with a space between the casing and the ink accommodation body.

Preferably the first seal and the second seal are formed integrally, and there is provided between the first seal and the second seal an air communication port communicating with a space between the casing and the ink accommodation body.

Preferably the first seal is provided on the ink supply body, and wherein the second seal is provided at the opening of the casing.

Preferably the first seal has a smaller diameter than the second seal.

Preferably there is provided inside the casing an ink absorption body configured to recover waste ink generated through rubbing the connection member (20) against the second seal when detaching the ink cartridge (50).

The present invention also provides an ink jet recording apparatus (10) comprising: an ink cartridge (50) which is equipped with a casing having an opening, a flexible ink accommodation body provided within the casing and accommodating ink, and an ink supply body attached to the ink accommodation body for ink supply;

an ink outlet path equipped with an ink outlet port (24) introducing the ink in the ink accommodation body into a recording head; a connection member (20) equipped with an air inlet path having an air inlet port (21) introducing air into a space portion between the casing and the ink accommodation body of the ink cartridge (50); an attachment portion in which the connection member (20) is arranged and to which the ink cartridge (50) is attached; an ink path communicating with the ink outlet path and supplying ink to the recording head; and an air pump communicating with the air inlet path and configured to send out air, air being introduced into the ink cartridge (50) with the ink cartridge (50) attached to the attachment portion to effect pressurization ink supply, wherein the ink outlet port (24) is provided at the distal end side of the connection member (20) and the air inlet port (21) is provided between the ink outlet port (24) and a base portion of the connection member (20), and wherein the ink cartridge (50) includes a first seal provided on the downstream side of an insertion/extraction route of the connection member (20) and a second seal provided on the upstream side thereof, the first seal being brought into peripheral contact with the connection member (20) in a region between the ink outlet port (24) of the connection member (20) and the air inlet port (21) to thereby effect sealing, the second seal being brought into peripheral contact with the connection member (20) in a region between the air inlet port (21) and the base portion of the connection member (20), and there is provided between the first seal and the second seal a gap communicating with a space between the casing and the ink accommodation body.

Preferably the ink jet recording apparatus further comprises: an ink absorption body provided within the casing, wherein the first seal and the second seal are of the same diameter, and the air inlet port (21) and the ink outlet port (24) of the connection member (20) are arranged in a pipe body of a uniform diameter, whereby, when detaching the ink cartridge (50) from the attachment portion, the connection member (20) is rubbed against the second seal, and the ink absorption body recovers waste ink generated through wiping-off of ink adhering to the connection member (20).

The present invention also provides an ink cartridge (50) adopting a construction in which an air seal and an ink seal are arranged on the cartridge side and in which sealing between the ink cartridge (50) and the recording apparatus is performed with a radial seal.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An ink cartridge for supplying ink to a recording apparatus upon connection to the recording apparatus, the ink cartridge comprising:

a casing having an interior and an opening;

a flexible ink accommodation body, for accommodating ink, provided within the interior of the casing;

an ink supply body, attached to the ink accommodation body, for supplying ink in an ink-flow direction from the ink accommodation body to the recording apparatus in the case that the cartridge is connected to the recording apparatus;

a first sealing portion having elasticity;

a second sealing portion having elasticity, wherein the second sealing portion is provided downstream, ink-flow direction, of the first sealing portion, wherein the first sealing portion is arranged to retain ink in the ink accommodation body in the case that the cartridge is not connected to the recording apparatus, wherein the second sealing unit is arranged to form a sealing engagement with the recording apparatus when the cartridge is connected to the recording apparatus, and wherein, between the first sealing portion and the second sealing portion, there is provided a gap communicating with an area between the casing and the flexible ink accommodation body.

2. The ink cartridge according to claim 1, comprising a valve member and a resilient biasing unit for biasing the valve member against the first sealing unit.

3. The ink cartridge according to claim 1, wherein the first sealing unit and the second sealing unit are formed integrally in an integral sealing member, and the integral sealing member comprises a port, between the first sealing portion and the second sealing unit, communicating with the interior of the casing.

4. The ink cartridge according to claim 3, wherein the ink supply body comprises a further port and wherein the integral sealing member is positioned in the ink supply body such that the first and second ports are aligned.

5. The ink cartridge according to claim 1, wherein the first and second sealing unit are separated from each other.

6. The ink cartridge according to claim 5, wherein the first sealing unit is provided on the ink supply body, and wherein the second sealing portion is provided at the opening of the casing.

7. The ink cartridge according to claim 1, wherein the first sealing portion has a smaller sealing diameter than the second sealing portion.

8. The ink cartridge according to claim 1, wherein the interior of the casing comprises an ink absorption body arranged to absorb ink from the second sealing portion.

9. An ink jet recording system comprising an ink jet recording apparatus connected to an ink cartridge according to claim 1, the ink jet recording apparatus comprising:

an elongate connection member having a proximal end connected to the recording apparatus and a distal end for connection to an ink cartridge, the connection member comprising an air inlet path leading to an air inlet port, for introducing air into the connected ink cartridge, comprising an ink outlet path leading from an ink outlet port, for introducing ink into the recording apparatus, and comprising a rib-like protrusion arranged on a periphery of a pipe body of the elongate connection member, wherein the ink outlet port is provided at the distal end of the connection member and the air inlet port is provided between the ink outlet port and the proximal end of the connection member; and a pump for supplying compressed air to the air inlet path, wherein at least part of the elongate connection member is inserted through the opening of the ink cartridge casing into the ink supply body such that the air inlet port is positioned between the first and second sealing portion and in communication with the interior of the casing via the gap between the first and second sealing portion.

10. The ink jet recording system according to claim 9, wherein the ink cartridge comprises a valve member and a resilient biasing portion for biasing the valve member against the first sealing portion and wherein the distal end of the connection member is arranged to push the valve member away from the first sealing portion such that ink can flow from the ink accommodation body to the ink outlet port.

11. The ink jet recording system according to claim 9, wherein the ink supply body of the ink cartridge extends from the opening and comprises a first port and wherein the first sealing portion and the second sealing portion are formed integrally in an integral sealing member, comprising a second port between the first and second sealing portion, wherein the integral sealing member is positioned in the ink supply body such that the first and second ports are aligned with each other and with the air inlet port such that the air inlet port is in communication with the interior of the casing via the first and second ports.

12. The ink jet recording system according to claim 9, wherein the first and second sealing unit are separated from each other in the ink-flow direction, forming the gap between them, and wherein the connection member is positioned such that the air inlet port is aligned with the gap and is thereby in communication with the interior of the casing.

13. The ink jet recording system according to claim 9, wherein the second sealing unit is arranged to wipe off ink from the distal end of the connection member upon disconnection of the ink cartridge from the ink jet recording apparatus.

14. The ink jet recording system according to claim 13, wherein the ink cartridge comprises an ink absorption body arranged to recover the ink wiped from the connection member by the second sealing portion.

15. The ink cartridge according to claim 1, wherein a surface of the first sealing unit closer to the second sealing portion is covered with a cap.

16. The ink cartridge according to claim 1, wherein the second sealing portion is covered with a cover member.

17. The ink cartridge according claim 1, wherein the second sealing portion is provided with one opening communicating with the interior of the casing.

18. The ink cartridge according to claim 1, wherein the first sealing portion and the second sealing portion are separate portions.

* * * * *